US011608640B2

(12) United States Patent
Svec

(10) Patent No.: US 11,608,640 B2
(45) Date of Patent: Mar. 21, 2023

(54) PANELIZED ROOFING SYSTEM

(71) Applicant: BMIC LLC, Dallas, TX (US)

(72) Inventor: James A. Svec, Kearny, NJ (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 17/752,957

(22) Filed: May 25, 2022

(65) Prior Publication Data

US 2022/0381032 A1 Dec. 1, 2022

Related U.S. Application Data

(60) Provisional application No. 63/192,684, filed on May 25, 2021.

(51) Int. Cl.
*E04D 3/361* (2006.01)
*E04D 3/362* (2006.01)

(52) U.S. Cl.
CPC ..... *E04D 3/362* (2013.01); *E04D 2003/3615* (2013.01)

(58) Field of Classification Search
CPC ..... E04D 2001/3432; E04D 2001/343; E04D 1/34; E04D 1/30; E04D 1/2914; E04D 1/2916; E04D 1/1963; E04D 1/2984; E04D 7/005; E04D 2003/3615; E04D 2003/0818; E04D 2003/0843; E04D 2003/0856; E04D 3/35; E04D 3/351; E04D 3/352; E04D 3/36; E04D 3/3605; E04D 3/3606; E04D 3/3607; E04D 3/365; E04D 3/38; E04D 3/302; E04D 3/24
See application file for complete search history.

(56) References Cited

U.S. PATENT DOCUMENTS

| | | | |
|---|---|---|---|
| 550,325 | A | 11/1895 | Kinnear |
| 1,329,794 | A | 2/1920 | Moomaw |
| 1,484,166 | A | 2/1924 | Wolk |
| 1,539,632 | A | 5/1925 | Belding |

(Continued)

FOREIGN PATENT DOCUMENTS

| | | | |
|---|---|---|---|
| AU | 2018200682 | A1 | 8/2018 |
| CH | 346993 | A | 6/1960 |

(Continued)

OTHER PUBLICATIONS

Boral Steel Stone Coated Roofing; Batten-Less Installation Guidelines; BoralRoof.com; pp. 1-40; dated Oct. 2018.

(Continued)

*Primary Examiner* — Jessica L Laux
(74) *Attorney, Agent, or Firm* — Womble Bond Dickinson (US) LLP

(57) ABSTRACT

A roofing system including a plurality of roofing panels that can be releasably secured to rafters or other supports of the roof by connectors. In embodiments, the connectors can include first and second connectors, each of which can include a plate with a projection extending therefrom, and with the plates defining flanges on each side of the projection. The plates of the first and second connectors are configured to seat on and at least partially extend along one of the rafters of the roof structure and along exterior facing surfaces of adjacent ones of the roofing panels to releasably secure the roofing panels to the rafters.

19 Claims, 5 Drawing Sheets

(56) References Cited

U.S. PATENT DOCUMENTS 1,732,368 A 10/1929 Lane
1,743,206 A 1/1930 Fulenwider et al.
2,042,890 A 6/1936 Fulenwider et al.
3,347,001 A 10/1967 Cosden
3,363,380 A 1/1968 Merrill
3,412,517 A 11/1968 Ellis et al.
3,720,031 A 3/1973 Wilson et al.
3,760,546 A 9/1973 Martin et al.
3,844,087 A * 10/1974 Schultz ..... E04D 3/08 52/200
3,848,383 A 11/1974 Wilson et al.
4,010,590 A 3/1977 Reinke
4,021,981 A 5/1977 Van Wagoner
4,079,561 A 3/1978 Vallee
4,114,330 A * 9/1978 Sukolics ..... E04D 3/08 52/460
4,135,342 A 1/1979 Cotter
4,163,351 A 8/1979 Ishikawa
4,189,889 A 2/1980 Yanoh
4,343,126 A 8/1982 Hoofe, III
4,439,969 A * 4/1984 Bartlett ..... E04D 3/40 52/461
4,464,215 A 4/1984 Cogliano
4,445,305 A 5/1984 Orie, Sr.
4,453,349 A 6/1984 Ryan
4,468,903 A 9/1984 Eaton et al.
4,499,700 A 2/1985 Gustafsson
4,580,383 A 4/1986 Pittman et al.
4,592,183 A 6/1986 See
4,621,472 A * 11/1986 Kloke ..... E04D 3/08 52/204.591
4,643,080 A 2/1987 Trestle et al.
4,651,489 A * 3/1987 Hodges ..... E04D 13/1618 52/409
4,680,905 A * 7/1987 Rockar ..... E04D 3/08 52/200
4,683,697 A 8/1987 Gregg
4,775,567 A 10/1988 Harkness
4,856,236 A 8/1989 Parker
4,932,184 A 6/1990 Waller
4,986,744 A 1/1991 Weisweiler et al.
5,038,535 A 8/1991 Van Praag, III
5,058,333 A * 10/1991 Schwartz ..... E04D 13/0445 52/794.1
5,074,093 A 12/1991 Meadows
5,092,099 A 3/1992 Valente
5,245,803 A 9/1993 Haag
5,295,338 A 3/1994 Guffey et al.
5,345,740 A 9/1994 Huang
5,349,801 A 9/1994 Verbofsky
5,465,543 A 11/1995 Seifert
5,469,680 A 11/1995 Hunt
5,535,567 A 7/1996 Cahoon
5,557,896 A 9/1996 Imeokparia et al.
5,598,677 A 2/1997 Rehm, III
5,613,337 A 3/1997 Plath et al.
5,636,481 A 6/1997 De Zen
5,642,596 A 7/1997 Waddington
5,743,059 A 4/1998 Fifield
5,752,355 A 5/1998 Sahramaa
5,768,844 A 6/1998 Grace, Sr. et al.
5,881,501 A 3/1999 Guffey et al.
D414,568 S 9/1999 Hedges et al.
6,105,314 A 8/2000 Stocksieker
6,122,886 A * 9/2000 Richardson ..... E04D 3/08 52/282.1
6,272,807 B1 8/2001 Waldrop
6,282,858 B1 9/2001 Swick
D449,121 S 10/2001 Hunter et al.
6,298,619 B1 10/2001 Davie
6,314,704 B1 11/2001 Bryant
RE38,210 E 8/2003 Plath et al.
6,606,823 B1 8/2003 McDonough et al.
6,647,687 B2 11/2003 Kern
6,698,157 B1 * 3/2004 Porter ..... E04C 2/296 52/592.1
6,772,569 B2 8/2004 Bennett et al.
6,907,701 B2 6/2005 Smith
6,928,781 B2 8/2005 Desbois et al.
6,990,779 B2 1/2006 Kiik et al.
7,246,474 B2 7/2007 Dombek et al.
7,444,782 B2 11/2008 Crowell
7,513,084 B2 4/2009 Arguelles
7,658,038 B2 2/2010 Mower et al.
7,739,848 B2 6/2010 Trout
7,748,191 B2 7/2010 Podirsky
7,877,936 B2 2/2011 Uffner et al.
7,921,619 B2 4/2011 Snyder et al.
7,984,591 B2 7/2011 Cashin et al.
D643,133 S 8/2011 Steffes et al.
8,074,417 B2 12/2011 Trabue et al.
8,132,372 B2 3/2012 Mower et al.
8,158,450 B1 4/2012 Sheats et al.
8,171,689 B2 5/2012 Pierson et al.
8,206,539 B2 6/2012 Kalanoglu
8,215,083 B2 * 7/2012 Toas ..... E04B 1/80 52/406.1
8,316,609 B2 11/2012 Ben-Zvi
8,323,770 B2 12/2012 Mehta et al.
8,426,017 B2 4/2013 Paradis et al.
8,470,436 B1 6/2013 Paradis et al.
8,476,523 B2 7/2013 Bennett
8,516,744 B2 8/2013 Dubner
8,567,149 B2 10/2013 Kuzmin
8,590,267 B2 11/2013 Jaffee
8,650,827 B2 * 2/2014 Givoni ..... E04C 2/543 52/459
8,713,882 B2 5/2014 Kalkanoglu et al.
D707,856 S 6/2014 Cochrane
8,869,478 B2 10/2014 Gianolio
8,875,454 B2 11/2014 Arguelles
8,910,428 B2 12/2014 Rule et al.
9,027,298 B1 5/2015 Martinez
9,032,679 B2 5/2015 Propst
9,181,704 B2 11/2015 Rasmussen et al.
D754,885 S 4/2016 Rasmussen et al.
9,404,261 B2 8/2016 Johnson et al.
9,611,647 B2 4/2017 Yang
9,636,892 B2 5/2017 Albert et al.
9,689,164 B2 6/2017 Rasmussen et al.
9,783,995 B2 10/2017 Meersseman et al.
9,840,851 B2 12/2017 Propst
9,876,132 B2 1/2018 Morad et al.
9,890,537 B2 2/2018 Martin et al.
9,970,197 B2 5/2018 Maurer et al.
10,027,274 B2 7/2018 Van Giesen et al.
10,087,634 B2 10/2018 Johnson et al.
10,119,289 B2 * 11/2018 Kissell ..... E04H 7/065
10,240,338 B2 3/2019 Durst et al.
10,259,199 B2 4/2019 Beuchel et al.
10,294,669 B2 5/2019 Prygon
10,415,245 B2 9/2019 Bennett et al.
10,538,905 B2 1/2020 Pirrung
10,749,460 B2 8/2020 Guo
2003/0159379 A1 8/2003 Pickler
2005/0170720 A1 8/2005 Christiansen et al.
2005/0210808 A1 9/2005 Lawson et al.
2006/0019598 A1 1/2006 Rotter
2007/0137132 A1 6/2007 Plowright
2007/0181174 A1 8/2007 Ressler
2009/0258972 A1 10/2009 Illiuta et al.
2009/0293864 A1 12/2009 Augenbraun et al.
2010/0186334 A1 7/2010 Seem
2010/0313506 A1 12/2010 Schoell
2011/0009024 A1 1/2011 Clark
2012/0225603 A1 9/2012 Trinch
2012/0227343 A1 9/2012 Curtin et al.
2013/0186028 A1 7/2013 Resso et al.
2014/0165480 A1 6/2014 Jenkins et al.
2014/0190096 A1 7/2014 Kacandes
2014/0190104 A1 7/2014 Nicholson
2015/0267409 A1 9/2015 Rasmussen et al.
2015/0354224 A1 12/2015 Maurer et al.

(56) References Cited

U.S. PATENT DOCUMENTS

| | | | |
|---|---|---|---|
| 2015/0372635 | A1 | 12/2015 | Praca et al. |
| 2016/0123013 | A1 | 5/2016 | Rasmussen et al. |
| 2017/0019061 | A1 | 1/2017 | Van Giesen et al. |
| 2017/0058523 | A1 | 3/2017 | Kennedy |
| 2017/0145697 | A1 | 5/2017 | Anthony |
| 2017/0298614 | A1 | 10/2017 | Gaudio et al. |
| 2018/0002939 | A1 | 1/2018 | Harve et al. |
| 2018/0038109 | A1 | 2/2018 | Kennedy |
| 2019/0078332 | A1 | 3/2019 | Khajani et al. |
| 2020/0040582 | A1 | 2/2020 | Boss et al. |
| 2020/0149264 | A1 | 5/2020 | Pirrung |
| 2020/0274483 | A1 | 8/2020 | Sanglap et al. |
| 2021/0156150 | A1 | 5/2021 | Boss et al. |

FOREIGN PATENT DOCUMENTS

| | | | |
|---|---|---|---|
| CN | 107514088 | A | 12/2017 |
| CN | 108060733 | A | 5/2018 |
| CN | 108149849 | A | 6/2018 |
| CN | 106665317 | B | 4/2020 |
| EP | 0550800 | A1 | 7/1993 |
| EP | 1989366 | B1 | 7/2009 |
| FR | 2569218 | A1 | 2/1986 |
| RU | 2185959 | C1 | 7/2002 |
| RU | 116808 | U1 | 6/2012 |
| RU | 2015107299 | A | 10/2016 |
| RU | 2605910 | C2 | 12/2016 |
| WO | WO2005/078209 | A1 | 8/2005 |
| WO | WO2005/098168 | A2 | 10/2005 |
| WO | WO2012/120208 | A2 | 9/2012 |
| WO | WO2012/136194 | A2 | 10/2012 |
| WO | WO2018/023147 | A1 | 2/2018 |
| WO | WO2021/146567 | A1 | 7/2021 |

OTHER PUBLICATIONS

Cost Comparison Helper; http://costcomparisonhelper.com/compare-prices/roofing/steel-roofing.html; Compare Average Cost of Steel Roofing InstallationISteel Roofing Price Quotes; ; pp. 1-4; available as of Nov. 20, 2014.

Guilford's Seamless Gutters; http://guilfordsllc.com/metal-roof-profile-style-options/; Metal Roof Profile—Style Options Guilford's Metal Roofing; ; pp. 1-3; available as of Nov. 20, 2014.

Windows of Michigan; http://windowsofmichigan.com/products/metal-roofing/permanent-metal-shakes.html; Permanent Metal Shake; pp. 1-3; Nov. 20, 2014.

AMR—Advantage Metal Roofs; http://www.advantagementalroofs.com/country_manor_shake.html; Austin Texas Metal Roofing Professionals—Advantage Metal Roofs; pp. 1-2; available as of Nov. 20, 2014.

* cited by examiner

PANELIZED ROOFING SYSTEM

CROSS-REFERENCE

The present Patent Application claims the benefit of U.S. Provisional Patent Application No. 63/192,684, filed May 25, 2021.

INCORPORATION BY REFERENCE

The disclosure of U.S. Provisional Patent Application No. 63/192,684, filed May 25, 2021, is specifically incorporated by reference herein as if set forth in its entirety.

TECHNICAL FIELD

This disclosure relates generally to roofing systems and more specifically to roofing panels and systems for connecting roofing panels along a roof structure.

BACKGROUND

A need exists for a roofing system and method for assembling roofing panels such as large structural roofing panels on rafters and/or other supports. The roofing system should be simple to install, yet securely attach the roofing panels to the rafters and to adjacent roofing panels in an array to provide a waterproof roof assembly. The roofing system should allow for disassembly of one or more of the roofing panels (e.g., for replacement) while allowing the remaining roofing panels to remain in an assembled, interconnected configuration. It is to the provision of such a roofing system and related methods that the present disclosure is primarily directed.

SUMMARY

Briefly described, a roofing system is formed using roofing panels (e.g., laminated structural roofing panels, oriented strand board, solid materials such as wood or metal panels, and/or other suitable laminated or substantially unitary constructions) that have an outer exposed side or exterior facing surface and an inner side or interior facing surface that can face the interior of a building structure when installed as part of a roof for the building structure. The roofing panels can be secured to rafters or other supports of the roof by connectors. In some embodiments, the connectors can include first and second connectors, which each can include a plate with at least one projection extending therefrom, the plates defining flanges on each side of the at least one projection and configured to seat on and at least partially extend along one of the rafters of the roof structure or along an exterior facing surface of one or more roofing panels.

In embodiments, the connectors can have a "T" shape or configuration with the projections thereof extending in a direction generally perpendicular to the flanges of their plates. In other embodiments, the connectors can have an "I" shape or configuration with each connector having a first or top plate defining a pair of flanges, a second or bottom plate defining a second pair of flanges, and a projection extending therebetween.

In embodiments, the connectors can be configured in pairs including a first or bottom connector and a second or top connector. Each first or bottom connector can be secured to an upper surface of a rafter of the roof (e.g., by fasteners, or other mechanical attachments, adhesive, and/or other features). Adjacent roofing panels can be secured to the flanges of the first connector (e.g., by fasteners, adhesive materials, and/or other engaging features) so that a projection of the first connector is at least partially received along a seam or joint defined between the two adjacent roofing panels. A second or top connector can be positioned opposite an associated one of the first or bottom connectors mounted along the rafter, with the flanges of the second connector extending along exterior facing surfaces of the adjacent roofing panels and with a projection extending downwardly; and with each pair of opposing flanges of the first and second connectors defining a recess in which a peripheral sides edge of a roofing panel can be received and captured. The projection of the second connector can be at least partially received along the seam or joint defined between the adjacent roofing panels, and the flanges of the second connector can be secured to the roofing panels by fasteners and/or an adhesive (e.g., the flanges of the second connector can be adhered or mechanically attached to the exterior facing surfaces of the two adjacent roofing panels by a sealant or similar adhesive). The first and second connectors also can be secured together by fasteners extending therebetween.

In some embodiments, the roofing panels can be configured to act as a structural component of the roofing system that can be easily handled and installed by individual installers. In embodiments, the roofing panels are formed with a lightweight core sandwiched between layers of other materials, including at least a first layer of material, which can comprise wood, such as plywood, metal or a polymer material, and at least a second layer of material, which can comprise wood, such as plywood, metal, or a polymer material. Additional layers of materials also can be applied thereover. For example, a third layer that can comprise an exterior layer (e.g., a waterproofing layer) can be applied, extending along the exterior facing surface of each of the roofing panels.

In some embodiments, the exterior layer of a roofing panel can include an overlapping portion that extends beyond an edge of the roofing panel and that overlaps an adjacent roofing panel (e.g., at least partially overlapping a headlap portion of a roofing panel installed immediately downslope). The overlapping portion further can at least partially cover the seam or joint formed between adjacent roofing panels, with the flanges of the top connector engaging the exterior layer to create a substantially waterproof seal therealong. In some embodiments, the overlapping portion can be adhered, welded, and/or otherwise secured to the exterior surface of the adjacent roofing panel.

Various aspects of roofing systems incorporating structural roofing panels and connectors and methods forming roofing systems incorporating structural roofing panels and connectors, are provided by the present disclosure. For example, and without limitation, in one aspect, a roofing system is provided, comprising a plurality of rafters; a plurality of roofing panels comprising at least a first roofing panel and a second roofing panel positioned on opposite sides of at least one rafter; a first connector secured to the at least one rafter, wherein each of the first roofing panel and the second roofing panel is releasably secured to the first connector; and a second connector positioned opposite the first connector, the second connector releasably secured to the first roofing panel and the second roofing panel; wherein the second connector is releasably coupled to the first connector with adjacent peripheral side portions of the first roofing panel and second roofing panel engaged and held between the first connector and the second connector so as to couple the first roofing panel and second roofing panel together along the at least one rafter.

In embodiments of the roofing system, the first connector comprises at least one flange and a projection extending from at least one flange; wherein the at least one flange of the first connector is secured to at least one rafter and is releasably secured to the first roofing panel and the second roofing panel. In some embodiments, the second connector comprises at least one flange and a projection extending from at least one flange; wherein at least one flange of the second connector is releasably secured to the first roofing panel and the second roofing panel.

In some embodiments, the projection of the first connector and the projection of the second connecter each are at least partially received along a seam defined between the first roofing panel and the second roofing panel.

In embodiments, the first and second connectors each comprise a pair of flanges projecting from opposite sides of the projections, and wherein the projection and the flanges of the bottom first connector define a T-shaped cross-section of the first connector, and wherein the projection and the flanges of the top second connector define a T-shaped cross-section of the second connector.

In embodiments, the roofing system further comprises fasteners configured to be extended through at least some of the flanges of the first and second connectors and through the first and second roofing panels to releasibly secure the first and second connectors to the first and second roofing panels.

In embodiments of the roofing system, the projections of the first connector and the second connector each include a substantially triangular cross-section adjacent their respective flanges.

In some embodiments of the roofing system, the second connector is at least partially secured to an exterior surface of each of the first roofing panel and the second roofing panel with a sealant.

In embodiments of the roofing system, the plurality of roofing panels further comprises a third roofing panel positioned downslope from the first roofing panel, wherein at least the first roofing panel comprises an exterior layer having an overlap portion extending beyond an edge of the first roofing panel and at least partially overlapping the third roofing panel. In embodiments, the overlap portion of at least the first roofing panel is bonded to an exterior facing surface of the third roofing panel to at least partially form a seal over a seam formed between the first roofing panel and the third roofing panel.

In some embodiments of the roofing system, the roofing panels of the plurality of roofing panels comprise oriented strand board. In other embodiments, the roofing panels of the plurality of roofing panels comprise laminate panels.

In embodiments of the roofing system, each of the roofing panels of the plurality of roofing panels comprise a core, a first layer of material overlying the core, and a second layer of material underlying the core.

In embodiments, the core comprises a polyisocyanurate, polystyrene, PVC, polyethylene, polyamide, phenolic material, or a combination thereof; and the first and second layers each comprise a polymer material, metal, wood, or combination thereof.

In embodiments, the roofing system further comprises a third layer of material overlying the first layer of material, the third layer comprising a thermoplastic membrane, gripping layer, or combination thereof.

In another aspect, a roofing system is provided, comprising a plurality of rafters; a plurality of roofing panels, each of the roofing panels configured to span across a distances defined between one or more adjacent rafters of the plurality of rafters; a plurality of connectors each comprising a projection; at least one plate defining flanges positioned on each side of the projection; and wherein the at least one plate of one or more of the connectors is configured to be secured to one of the rafters of the plurality of rafters; wherein opposing flanges of the connectors are configured to define recesses on opposite sides of the projections and in which adjacent peripheral side portions of a first roofing panel and an adjacent roofing panel are received and are releasably secured together in an array of roofing panels mounted along the plurality of rafters.

In embodiments of the roofing system, at least some of the connectors comprise a plurality of first and second connectors, and wherein the projection and the flanges of the first connector define a T-shaped cross-section of the first connector, and wherein the projection and the flange of the second connector define a T-shaped cross-section of the second connector.

In some embodiments, at least some of the connectors comprise an I-shaped construction, with each connector including a top plate and a bottom plate with the projection of each connector extending between the top and bottom plate thereof.

In embodiments of the roofing system \each of the roofing panels comprises a core, a first layer of material overlying the core, and a second layer of material underlying the core.

In some embodiments, the core comprises a polyisocyanurate polystyrene, PVC, polyethylene, polyamide, phenolic material, or a combination thereof; and the first and second layers each comprise a polymer material, metal, wood, or combination thereof.

In embodiments of the roofing system, the connectors comprise first and second connectors, wherein the first connectors include flanges configured to mount along the rafters, and the second connectors include flanges configured to mount along an exterior facing surface of the roofing panels in an opposing arrangement with the first connectors, and further comprising a plurality of fasteners configured to be extended through each of the flanges of the first connectors and the second connectors and the roofing panels to releasably connect the roofing panels to the rafters.

Accordingly, embodiments of roofing panels and methods for forming a roof structure that are directed to the above discussed and other needs are disclosed. The foregoing and other advantages and aspects of the embodiments of the present disclosure will become apparent and more readily appreciated from the following detailed description and the claims, taken in conjunction with the accompanying drawings. Moreover, it is to be understood that both the foregoing summary of the disclosure and the following detailed description are exemplary and intended to provide further explanation without limiting the scope of the present disclosure.

BRIEF DESCRIPTION OF THE DRAWINGS

The accompanying drawings, which are included to provide a further understanding of the embodiments of the present disclosure, are incorporated in and constitute a part of this specification, illustrate embodiments of this disclosure, and together with the detailed description, serve to explain the principles of the embodiments discussed herein. No attempt is made to show structural details of this disclosure in more detail than may be necessary for a fundamental understanding of the exemplary embodiments discussed herein and the various ways in which they may be practiced.

DETAILED DESCRIPTION

The present disclosure will be described generally before referring in additional detail to the various drawing figures attached hereto. In embodiments, a roofing system is provided wherein roofing panels are assembled to rafters and/or other supports to form a roof which can include commercial roof structures as well as residential and other sloped roof structures. The roofing system can include a plurality of roofing panels, a plurality of connectors that can be secured to respective rafters of the roof, and to pairs of adjacent roofing panels of the plurality of roofing panels. In embodiments, the connectors can include a first or bottom connector and a second or top connector. Each of the first connectors can be secured to a bottom or interior side of two adjacent roofing panels and each of the second connectors can be secured to a top or exterior side of two adjacent roofing panels. The first connectors and/or the second connectors can be releasably attached to the respective roofing panels so that one or more of the roofing panels can be removed from the assembled roof while the remainder of the roof remains in the assembled configuration.

In addition, while the connectors have been illustrated in some non-limiting embodiments as including a pair of opposing connectors, with one or both having a "T" shape or configuration, in other embodiments, the connectors can have a substantially unitary construction. For example, in embodiments, the connectors could be formed with an "I" shape or configuration with a first or bottom plate defining a first pair of flanges (e.g. bottom flanges configured to engage the bottom surfaces of a pair of adjacent panels), a second or top plate defining a second pair of flanges (e.g. top flanges configured to engage the top or exterior facing surfaces of a pair of adjacent panels), and with a projection or web extending between and connecting the first and second plates.

Figure 1:
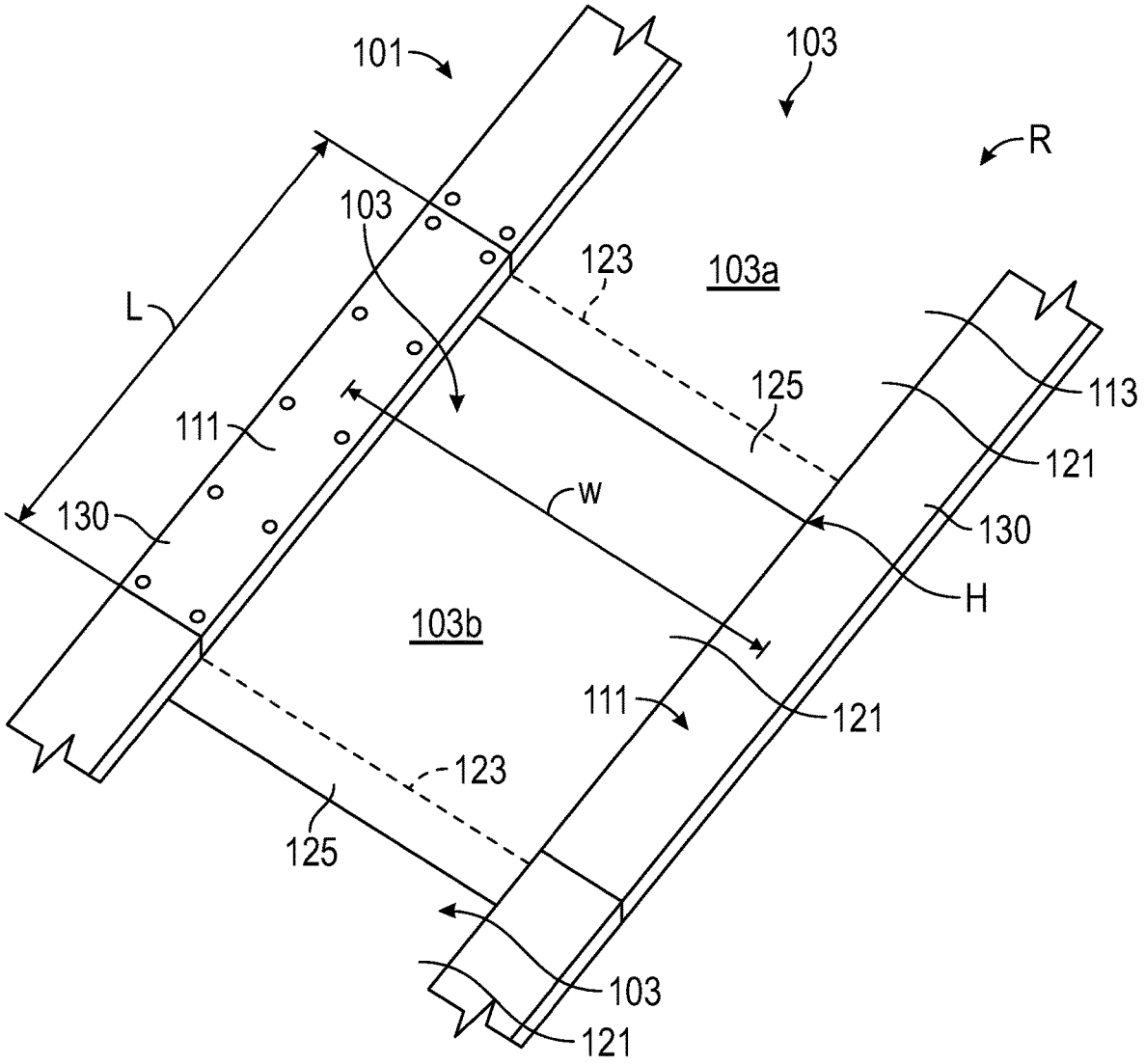
FIG. 1 is a schematic exterior perspective view of a roofing system according to an embodiment of the present disclosure.
Figure 2:
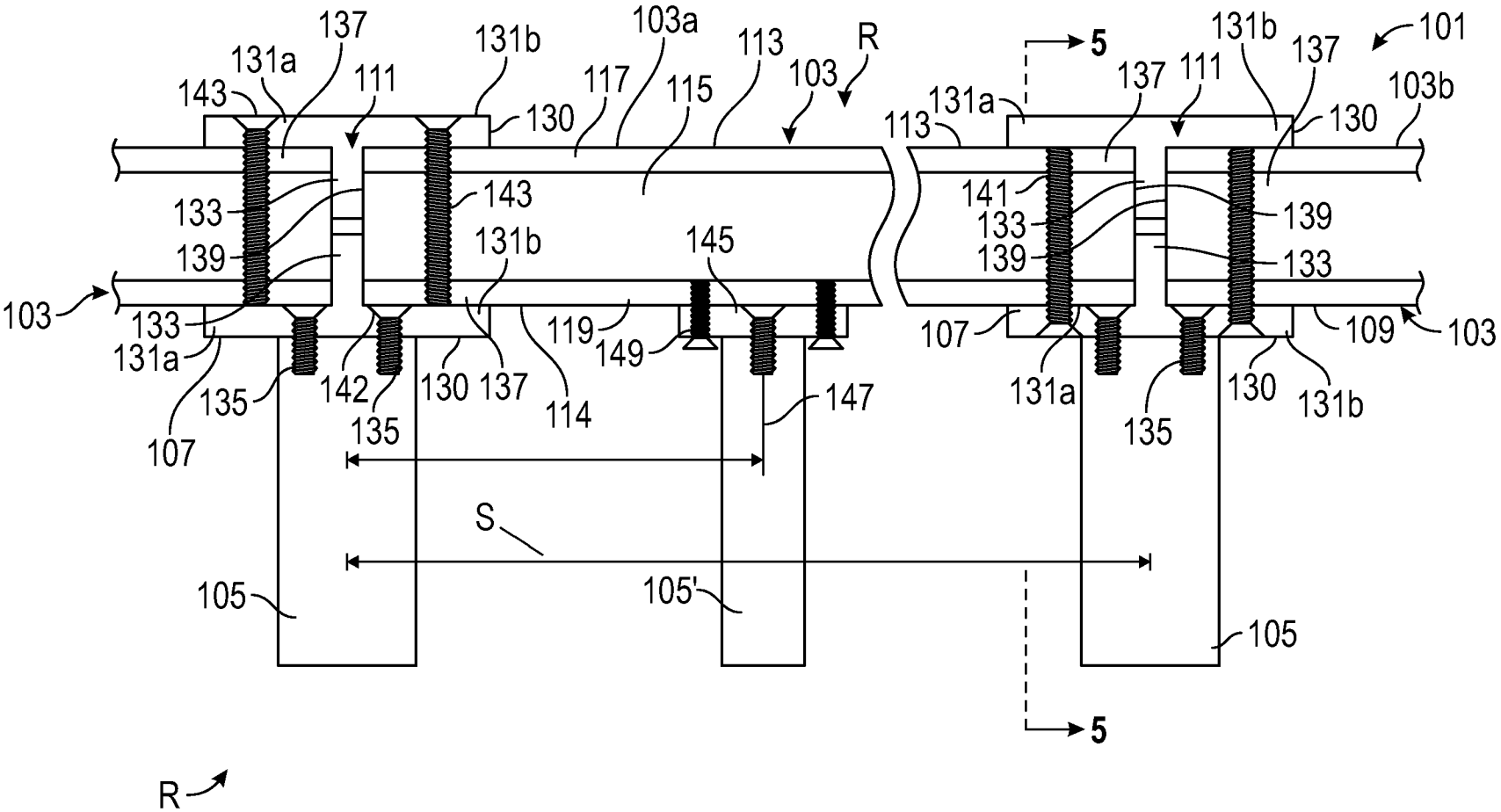
FIG. 2 is a schematic cross-sectional view of the roofing system of claim 1.

FIGS. 1 and 2 illustrate an embodiment of a roofing system 101 for forming a roof R according to the present disclosure. The roofing system 101 can include a plurality of roofing panels 103 mounted to rafters 105 by a plurality of connectors including, in embodiments, first connectors 107 (e.g., shown as rafter securing devices), and second connectors 111. As shown in FIG. 2, each of the first connectors 107 can be secured to an interior facing surface 109 of two adjacent roofing panels 103 (e.g. first and second roofing panels 103A/103B) positioned on opposite sides of a rafter 105, and with the side edges 139 of each roofing panel 103 supported by the rafter. In addition, the second connectors 111 (e.g., shown as top securing devices) each can be secured to an exterior facing surface 113 of the adjacent roofing panels 103. As shown in FIG. 2, the first and second connectors 107, 111 can be positioned along the rafters 105 (e.g., extending parallel to the rafters) and along the slope of the roof, with the second connectors 111 positioned opposite the first connectors 107.

In some embodiments, the connectors 107, 111 can be formed of metal such as aluminum (e.g., oxidized aluminum with a powder coat), or can be formed from synthetic or composite materials, and/or any other suitable materials. The material of the connectors generally will include functional or performance characteristics such as being lightweight while still possessing high strength, rigidity, and Ultraviolet (UV) and weather resistance (e.g. adapted to withstand exposure to sunlight, wind, rain, snow, extreme temperatures and extreme cold). In addition, while FIG. 2 illustrates the connectors as including cooperative first and second connectors 107/111 connected to an interior facing surface 109 and an opposing exterior facing surface 113 of the roofing panels 103, in some embodiments the connectors can comprise a substantially unitary construction, with the first and second connectors formed together and having a substantially "I" beam construction or configuration with a linking inner web projection.

In embodiments, the roofing panels 103 can include any suitable type of roofing panels. For example, in some embodiments, the roofing panels 103 can have sufficiently robust structural integrity to be spanned across a substantial distance to form a roofing structure of the roof, e.g. extending between widely spaced rafters or other supports without the need for underlying mid-span support rafters. Each roofing panel may be composed of a core 115 and various layers 117/119, including at least one overlaying layer 117 defining an exterior facing surface 113 adapted to withstand exposure to weather (e.g. withstand exposure to sun, wind, rain, snow, extreme temperatures and extreme cold) and also may have an underlying layer 119 defining an interior facing surface 109 that maybe finished and which can serve as the ceiling of a building on which the roofing panels 103 are installed. The roofing panels 103, in some embodiments, can include a foam core configured to be lightweight and easy to handle and install by a small crew or a single installer.

Figure 3:
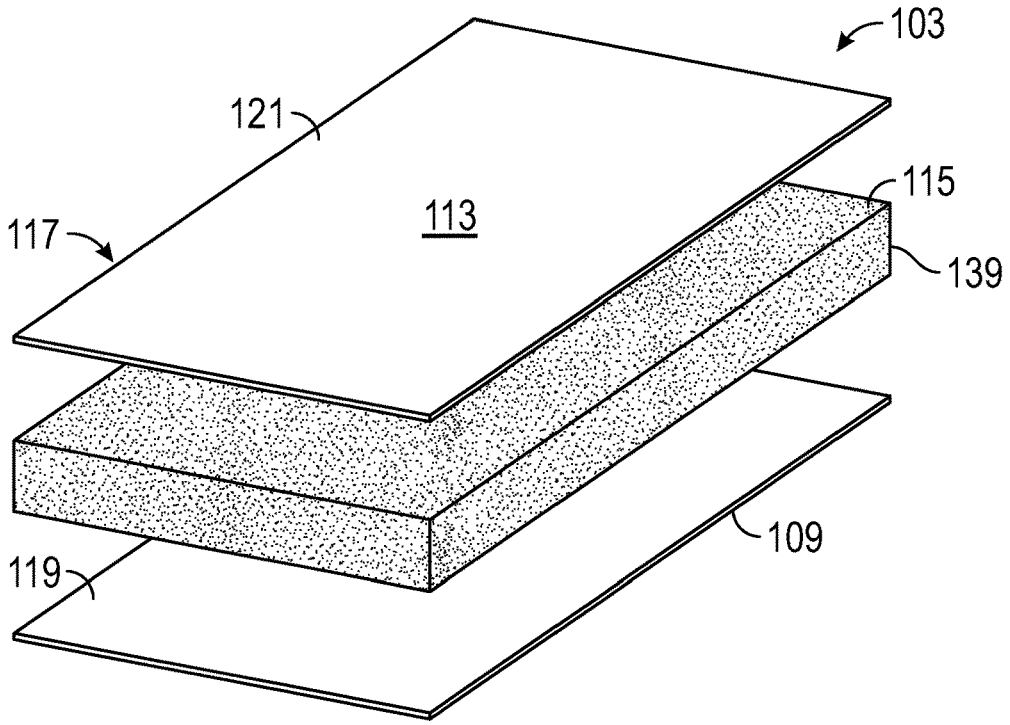
FIG. 3 is a schematic isometric exploded view of one example embodiment of a roofing panel according to principles of the present disclosure.

In one embodiment illustrated in FIG. 3, the roofing panels 103, in one embodiment, each can have a laminated or layered structure with a lightweight foam core 115 sandwiched between outer and/or inner layers 117/119 of one or more other materials. At least one of the materials of the outer and inner layers can include a polymer material, metal or wood such as a plywood, or wood veneer, oriented strand board (OSB), and/or combinations thereof. In embodiments, the layers applied to the core also may include or be covered with a fire resistant membrane such as, for example, Versashield® Solo brand fire resistant slip sheet available from GAF of Parsippany, N.J. In embodiments, a layer of self-gripping metal can be integrated with and adhered or bonded to one or more of the layers along the outer and/or inner sides of the roofing panel, and can be configured to couple or interconnect the roofing panels 103 along upper and lower edges (e.g. along headlap portions) between roofing panels of upper and lower courses, e.g. such layers can include a plurality of mechanical engagement or gripping features configured to mechanically couple layers together. In other embodiments, a layer of a waterproof membrane configured to resist passage of water therethrough, also can be applied to the core.

In some embodiments, the roofing panels 103 can include structural insulated panels (SIP) or otherwise can be of a strength sufficient to span a large distance without the need for substantial support from underlying roof rafters 105. For example, the roofing panels 103 and the connectors located therebetween could be configured to be supported on rafters 105 (FIG. 2) that are widely spaced, e.g., rafters arranged at a spacing S of 4 feet or greater on center, e.g. 4 feet to 8 feet, 4 feet to 7 feet, 4 feet to 6 feet, 4 feet to 5 feet, 5 feet to 8 feet, 5 feet to 7 feet, 5 feet to 6 feet, 6 feet to 8 feet, 6 feet to 7 feet, 7 feet to 8 feet, or any suitable distance and in some applications can enable elimination of rafters.

Alternatively, in embodiments, the roofing panels 103 and the connectors could be configured for being supported by more closely spaced rafters 105 (e.g., rafters 105' arranged at a spacing of 12 inches to 16 inches on center, such as indicated in FIG. 2, or any suitable distance). In still other embodiments, the roofing panels 103 can be configured to span roof trusses, or span an area between a peak or ridge of the roof and an eave or building wall of the building structure.

FIGS. 2 and 3 show an embodiment of an exemplary layered structure of a roofing panel 103 according to the present disclosure. The panel core 115 can be made of a lightweight material such as a foam, one example being a polyisocyanurate (ISO) or similar material. Other non-limiting examples of the lightweight material for the panel core 115 include polystyrene, PVC, polyethylene, polyamide, phenolic material, or a combination thereof. A plurality of layers can be applied to the upper or exterior facing surfaces and/or lower interior facing surfaces of the core 115 in a stacked, overlying arrangement as shown in FIGS. 2 and 3. For example, a first or upper layer 117, which can comprise wood, metal, polymer, and/or other suitable materials, is secured to the upper surface of the core 115, such as with an adhesive. A second or lower layer 119, which can comprise wood, metal, polymer, and/or other suitable materials, can be secured to the lower surface of the core 115, such as with an adhesive. Additionally, or alternatively, the first layer 117 and/or the second layer 119 can be attached to the core 115 by welding or otherwise bonding the layers 117, 119 to the core. In some embodiments, one or more of the layers 117, 119 can comprise a self-gripping metal sheet having a series of gripping features such as hooks, tabs, prongs or other engagement features configured to engage and grip and mechanically couple adjacent layers together. In addition, mechanical fasteners also could be used.

Figure 4:
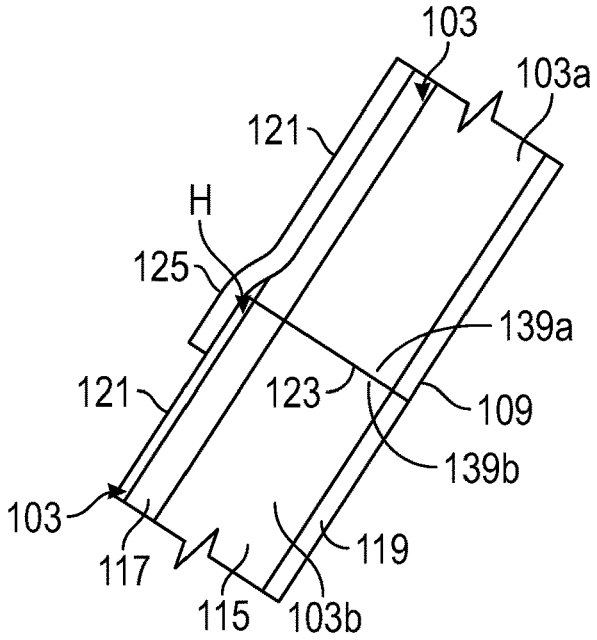
FIG. 4 is a schematic side elevation view of abutting roofing panels.

As shown in FIGS. 1 and 4, a third layer, which can comprise an exterior layer 121, which can include a membrane material, can be secured to the upper surface of roofing panel 103 (e.g., to the first layer 117). The exterior layer 121 may comprise a polymer membrane, such as a thermoplastic polyolefin (TPO) material, with desirable properties such as water-proofing, fire resistance or other properties, e.g., including a membrane material, such as Versashield® Solo, PHC, UPN, and/or other suitable materials.

In embodiments, the roofing panels 103 further could include any suitable number of layers of any suitable materials (e.g., including any of the roofing panel configurations disclosed in the incorporated-by-reference U.S. application Ser. No. 17/215,011). Alternatively, or in addition, any suitable roofing panels could be used, including roofing panels having a construction such as an engineered wood (e.g., oriented strand board), laminated constructions, solid materials, etc.

In embodiments, as illustrated in FIGS. 1-2, a plurality of roofing panels 103 can be arranged in an abutting relationship along the slope of the roof R. For example, as indicated in FIGS. 1 and 4, edges 139*a* of a roofing panel 103*a* can abut respective peripheral side edges 139*b* of adjacent panels 103*b*, a first roofing panel 103*a* can abut a second roofing panel 103*b* e.g. first immediately downslope and/or upslope along a headlap joint or seam 123. As also shown in FIGS. 1 and 4, an overlap portion 125 of the exterior layer 121 can extend beyond one or more edges 139*a*/139*b* of the adjacent roofing panels 103 to at least partially overlap a portion (e.g. a headlap portion) of the respectively adjacent roofing panels 103 along the slope of the roof.

In embodiments, the overlap portions 125 can be adhered, welded, and/or otherwise bonded or secured to the exterior surface of the adjacent roofing panel 103, so as to form a substantially waterproof seal over the seam 123 to resist migration of water through the seam 123 and between the roofing panels. For example, the overlap portions 125 can be configured with a peel-and-stick adhesive material or film for simple instillation of the roofing panels that can be covered with a release tape that can be removed in the field.

The roofing panels 103 can be of any suitable size for being mounted to rafters 105 having any suitable spacing. For example, in embodiments, the roofing panels can have a length (e.g., in a direction parallel with the rafters 105) of approximately 4 feet to 16 feet; approximately 4 feet to 14 feet; approximately 4 feet to 12 feet; approximately 4 feet to 10 feet; approximately 4 feet to 8 feet; approximately 4 feet to 6 feet; approximately 6 feet to 16 feet; approximately 6 feet to 14 feet; approximately 6 feet to 12 feet; approximately 6 feet to 10 feet; approximately 6 feet to 8 feet; approximately 8 feet to 16 feet; approximately 8 feet to 14 feet; approximately 8 feet to 12 feet; approximately 8 feet to 10 feet; approximately 10 feet to 16 feet; approximately 10 feet to 14 feet; approximately 10 feet to 12 feet; approximately 12 feet to 16 feet; approximately 12 feet to 14 feet; approximately 14 feet to 16 feet or any suitable length. In some embodiments, the roofing panels can have different lengths arranged in any combination along the slope of the roof for fitting a particular size roof.

In an exemplary embodiment, the roofing panels 103 (FIG. 2) can have a width (e.g., in a direction that is perpendicular to the rafters 105) of approximately 2-4 feet or greater minus the width of a portion of the connectors 107, 111 as described in more detail below. For example, the roofing panels can be configured to mount on for rafters 105 having a spacing of 4 feet on center, 2 feet on center, 16 inches on center, or other fractions of 4 feet on center). Alternatively, the roofing panels 103 could have any suitable width for mounting to rafters having any suitable spacing, including spacing's greater than 4 feet.

In embodiments, the roofing panels may have cores 115 that can be made with various thicknesses of lightweight foam board depending on application and desired strength. In some embodiments, the core thickness is 0.75 inches to 12 inches. In other embodiments, the core thickness is 0.75 inches to 11 inches; 0.75 inches to 10 inches; 0.75 inches to 9 inches; 0.75 inches to 8 inches; 0.75 inches to 7 inches; 0.75 inches to 6 inches; 0.75 inches to 5 inches; 0.75 inches to 4 inches; 0.75 inches to 3 inches; 0.75 inches to 2 inches; 0.75 inches to 1 inches. In other embodiments, the core thickness is 1 inch to 12 inches; 2 inches to 12 inches; 3 inches to 12 inches; 4 inches to 12 inches; 5 inches to 12 inches; 6 inches to 12 inches; 7 inches to 12 inches; 8 inches to 12 inches; 9 inches to 12 inches; 10 inches to 12 inches; 11 inches to 12 inches. Additionally, in embodiments, the core thickness is 1 inch to 10 inches; 2 inches to 10 inches; 3 inches to 10 inches; 4 inches to 10 inches; 5 inches to 10 inches; 6 inches to 10 inches; 7 inches to 10 inches; 8 inches to 10 inches; 9 inches to 10 inches; 1 inch to 9 inches; 2 inches to 9 inches; 3 inches to 9 inches; 4 inches to 9 inches; 5 inches to 9 inches; 6 inches to 9 inches; 7 inches to 9 inches; 8 inches to 9 inches; 1 inch to 8 inches; 2 inches to 8 inches; 3 inches to 8 inches; 4 inches to 8 inches; 5 inches to 8 inches; 6 inches to 8 inches; 7 inches to 8 inches; 1 inch to 7 inches; 2 inches to 7 inches; 3 inches to 7 inches; 4 inches to 7 inches; 5 inches to 7 inches; 6 inches to 7 inches; 1 inch to 6 inches; 2 inches to 6 inches; 3 inches to 6 inches; 4 inches to 6 inches; 5 inches to 6 inches; 1 inch to 5 inches; 2 inches to 5 inches; 3 inches to 5 inches; 4 inches to 5 inches; 1 inch to 4 inches; 2 inches to 4 inches; 3 inches to 4 inches; 1 inch to 3 inches; 2 inches to 3 inches; 1 inch to 2 inches. Other core thicknesses can also be provided.

As shown in FIG. 2, in embodiments, each of the first connectors 107 and the second connectors 111 can have a generally T-shaped cross-section with base or plate 130 defining a pair of mounting flanges 131*a*, 131*b* and with a projection 133 extending from the plate 130 and located between the mounting flanges 131*a*, 131*b*. In exemplary embodiments, the flanges 131*a*, 131*b* and the projections 133 can have a thickness of approximately ⅛ inch to 1 inch; ⅛ inch to ¾ inch; ⅛ inch to ½ inch; ¼ inch to ⅛ inch, ¼ inch to 1 inch; ¼ inch to ¾ inch; ¼ inch to ½ inch; ½ inch to 1 inch; ½ inch to ¾ inch; ¾ inch to 1 inch; or could have any suitable thickness; and the projections 133 can extend from the plates 130 approximately ½ inch to 1 inch; ½ inch to 2 inches; ½ inch to 3 inches; ½ inch to 4 inches; ½ inch to 5 inches; ½ inch to 6 inches; 1 inch to 6 inches; 1 inch to 5 inches; 1 inch to 4 inches; 1 inch to 3 inches; 1 inch to 2 inches; 2 inches to 6 inches; 2 inches to 5 inches; 2 inches to 4 inches; 2 inches to 3 inches; 3 inches to 6 inches; 3 inches to 5 inches; 3 inches to 4 inches; 4 inches to 6 inches; 4 inches to 5 inches; 5 inches to 6 inches; or any suitable distance.

The first connectors 107 can be mounted along a top side of respective rafters 105 such as by fasteners 135, adhesives, and/or other suitable features so that the flanges 131*a*/131*b* of the first connectors 107 extend along the lengths of the rafters 105 (e.g., along the slope of the roof) with their projections 133 extending upwardly, away from the rafters 105. In some embodiments, the roofing panels 103 can be positioned on the first connectors 107 so that, for example, peripheral side portions 137 of each roofing panel 103 are supported on the respective flanges (131*a*/131*b*) of the first connectors 107 and so that the peripheral side edges 139 of each roofing panel 103 abut the projection 133.

As shown in FIG. 2, two adjacent roofing panels 103 (e.g. first and second roofing panels (103*a*/103*b*) are supported by each of the first connectors 107 so that the respective peripheral side portions 137 of the roofing panels are positioned on the respective flanges 131*a*, 131*b* on opposing sides of the projection 133 and with the respective peripheral side edges 139 abutting the projection 133. Alternatively, the side edges 139 could be slightly spaced from the projection 133 without departing from the disclosure.

In embodiments, one of the second connectors 111 can be positioned opposite to each of the first connectors 107 so that the plates 130 and flanges thereof define a recess in which the respective peripheral side portions 137 of the adjacent roofing panels are received and interleafed, and which will contact the exterior facing surfaces 113 of the adjacent roofing panels 103 along the respective peripheral side portions 137 of the adjacent roofing panels with the projections 133 of the second connectors 111 extending downwardly between the respective side edges 139 of the adjacent roofing panels. In exemplary embodiments, one or both of the side edges 139 of the adjacent roofing panels can abut the projections 133 of the second connector 111 and a corresponding first connector 107. Alternatively, the side edges 139 of the adjacent roofing panels could be spaced from the projection without departing from the disclosure. In embodiments, the projections 133 of the connectors can be configured to provide a space therebetween (in a direction parallel to the rafters 105) such that the recesses defined between the opposing flanges of each pair of associated first and second connectors, and in which the respective peripheral side portions 137 of the adjacent roofing panels are received, can be varied or adjusted to accommodate for receipt, engagement and capture of different thickness panels between the first and second connectors.

In embodiments, the first connector 107 and the second connector 111 can be attached to the roofing panels 103 by respective fasteners 141, 143, for example being received in bores, which can be formed as countersunk bores 142, in the flanges 131*a*, 131*b*. In embodiments, the side edges 139 and peripheral side portions 137 of the roofing panels are engaged and captured between the flanges of the first and second connectors, and the fasteners 141 can extend upwardly through the flanges 131*a*, 131*b* of the first connector 107 into the roofing panels 103 from the interior facing surfaces 109 of the roofing panels. The fasteners 143 can extend downwardly through the flanges 131*a*, 131*b* of the second connector 111 into the roofing panels 103 from the exterior surfaces 113. As shown in FIG. 2, the fasteners 141, 143 can extend partially through a portion or portions of the roofing panels 103, wherein the ends of the fasteners 141, 143 are spaced from the respectively opposing exterior or interior facing surfaces 113, 109 of the roofing panels. In other embodiments, the fasteners 141, 143 could extend any suitable distance into the roofing panels 103 to secure the roofing panels 103 to the connectors.

Figure 5:
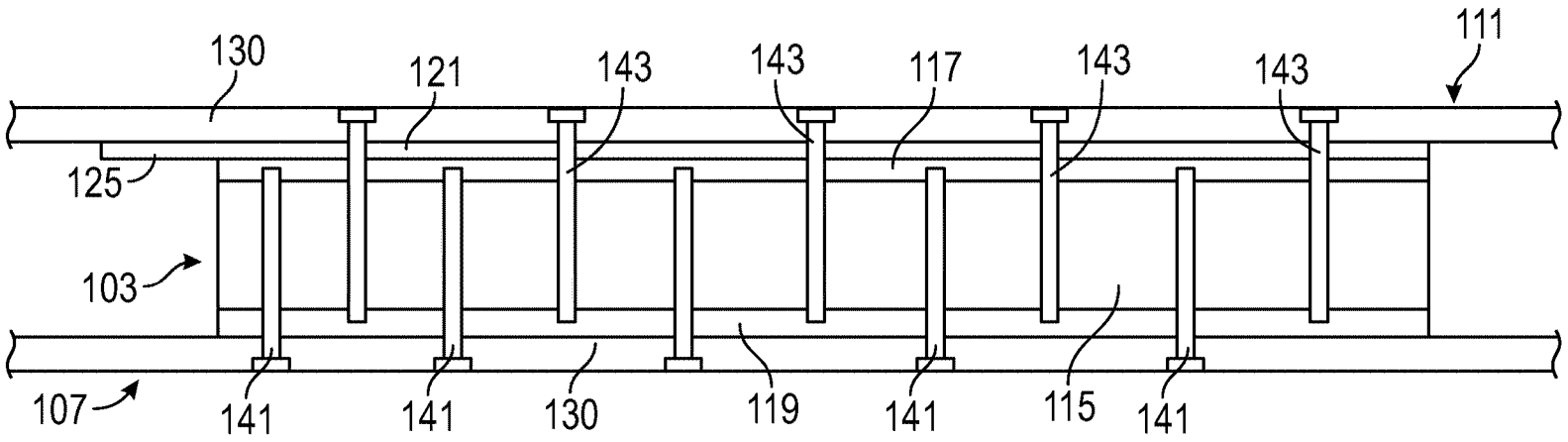
FIG. 5 is a schematic cross-sectional view taken along line 5-5 of FIG. 2.

As shown in FIG. 5, each of the roofing panels 103 can be secured to each of the connectors 107, 111 by multiple fasteners 141, 143, which can be spaced along the length of the roofing panels 103. In the embodiment shown in FIG. 5, the fasteners 141 are offset from the fasteners 143 along the length of the roofing panels 103, and can extend substantially through the roofing panels. While five fasteners 141 and five fasteners 143 are shown along the length of each roofing panel 103 for each of the connectors 107, 111 in FIG. 5, any suitable number of fasteners 141, 143 could be included.

In some embodiments, at least the flanges of the second connector 111 further can be secured to the exterior facing surfaces 113 of the roofing panels 103 by a sealant adhesive. Non-limiting examples of sealants can include DuraGrip™ brand adhesive available from GAF of Parsippany, N.J., and/or another water penetration resistant sealant) or other suitable material, which can help form a seal (e.g., a waterproof or watertight seal) at a junction between the flanges 131*a*, 131*b* of the second connector 111 and the exterior facing surfaces 113 of the roofing panels 103 as well as help create seal between the two adjacent roofing panels 103.

As shown in FIG. 2, in embodiments, the projections 133 are spaced apart from one another in each corresponding pair of connectors 107, 111. In alternative embodiments, the projections could be otherwise spaced (e.g., could be closer to one another such as for thinner roofing panels 103 or could be farther spaced apart such as for thicker roofing panels 103) or could abut one another. Accordingly, the connectors 107, 111 can accommodate roofing panels 103 having various different thicknesses (e.g., panels that are approximately 1 inch thick, 2 inches thick, 3 inches thick, 4 inches thick, 5 inches thick; 6 inches thick, 7 inches thick, 8 inches thick, 9 inches thick, 10 inches thick, 11 inches thick, 12 inches thick; or any suitable thickness).

In an exemplary embodiment, the width W (FIG. 1) of the roofing panels 103 can be approximately equal to a distance between the centers of the connectors minus the width of one of the projections 133 thereof. For example, and without limitation, in some embodiments, the roofing panels 103 can be mounted on first connectors that are spaced apart by 4 feet on center (e.g. mounted on rafters arranged at 4 foot spacings), and the width of the roofing panels can be approximately 4 feet minus the thickness of the projection so that the roofing panels 103 fit between the projections of a pair of spaced first connectors 107 mounted to a pair of spaced rafters. In some embodiments, the roofing panels 103 could be manufactured to have a width configured to accommodate for the thickness of the projections or the roofing panels 103; while in other embodiments, the roofing panels could be cut trimmed in the field as needed to fit between the projections prior to installation and assembly along the roof.

In embodiments where the rafters 105 are spaced by a shorter distance than the width of the roofing panels 103 (e.g., the rafters 105 are arranged at spacing's of 2 feet on center or 16 inches on center) the first connectors 107 can be arranged at different spacings e.g. being spaced at 4 feet on center), one or more spacers 145 can be mounted to supporting intermediate rafters 105 located between the first connectors 107. Only one of the intermediate rafters 105 and spacers 145 is shown in the schematic view of FIG. 2; however, additional intermediate rafters 105 and spacers 145 could be included between the rafters 105 secured to the first connectors 107. In the example embodiment shown schematically in FIG. 2, each spacer 145 can be mounted to the top of a rafter 105 by a fastener 147 and can be mounted to the bottom or interior facing surface 109 of the roofing panel 103 by fasteners 149. Alternatively, the spacer 145 could be otherwise secured to the rafter 105 and/or the roofing panel 103 or could be secured to only one of the rafter 105 or the roofing panel 103 without departing from the disclosure.

Figure 6:
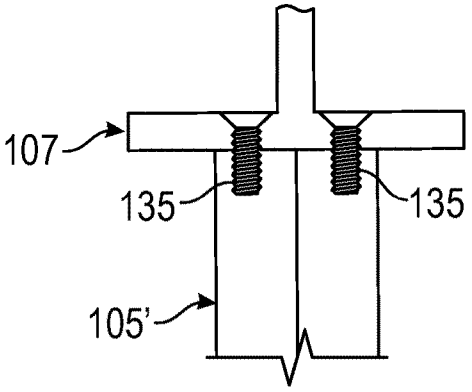
FIG. 6 is a schematic cross-sectional view of an alternative rafter configuration.

The thickness of the spacer 145 can be the same as the thickness of the plates 130 of the first connectors 107. In some embodiments, the intermediate rafters 105 and the spacers 145 could be omitted and the rafters 105 can be spaced at the same distance as the first connectors 107. For example, the rafters 105 could be spaced at 4 feet on center and one of the first connectors 107 could be secured to each of the rafters 105. In exemplary embodiments with wider spaced rafters 105, a double rafter configuration can be used, such as the double rafter 105' as shown in FIG. 6.

In embodiments, the roofing system 101 will be assembled to form a roof R. For example, a plurality of first connectors 107 can be mounted on respective rafters 105 at an appropriate spacing to accommodate the width of the roofing panels 103. The first connectors 107 can be secured along the length of the rafters 105 by the fasteners 135, which can be spaced along the length of the first connectors 107. Spacers 145 also can be mounted along the tops of the intermediate rafters 105, if needed, with the fasteners 149. The roofing panels 103 then can be positioned so that the peripheral side portions 137 thereof are supported on the flanges 131*a*/131*b* of respective first connectors 107 so that the side edges 139 of the roofing panels 103 are proximate to or abutting the respective projections 133 of the first connectors 107 (FIG. 2).

In embodiments, an overlap portion 125 of a TPO membrane applied as one of the layers, e.g. the exterior layer 121 of each roofing panel 103 can be positioned to overlap a headlap portion H of an adjacent roofing panel that is downslope from a first or second roofing panel (FIGS. 1 and 4). The overlap portion 125 can be adhered, welded, or otherwise secured to the exterior surface of the adjacent roofing panel to cover and seal the seam 123 at the interface between the adjacent roofing panels 103*a*, 103*b*. As shown in FIGS. 2 and 5, the first connectors 107 can be releasably secured to the peripheral side portions of roofing panels 103 along the interior facing surfaces thereof by the fasteners 141 via the flanges 131*a*/131*b*.

If utilized, the spacers 145 also can be releasably secured to the interior facing surface 109 of the roofing panel 103 with the fasteners 149 (FIG. 2). The second connectors 111 can be positioned opposite to the respective first connectors 107 with the projections 133 of the second connectors at least partially received between the side edges 139 of the roofing panels 103 and with the flanges 131*a*/131*b* of the second connectors in contact with the exterior facing surface 113 of the roofing panel 103. In some embodiments, a sealant can be applied to the exterior facing surface 113 and/or the interior of the flanges 131*a*/131*b* to form seals between the second connectors 111 and the roofing panels 103. The second connectors 111 also can be releasably secured to the roofing panels with the fasteners 143 or other mechanical connectors. The roofing system 101 could be otherwise erected using alternative joints without departing from the principles of the present disclosure.

As shown in FIGS. 1 and 2, the roofing panels 103 and the connectors 107, 111 of the roofing system 100 are positioned in an assembled configuration on the rafters 105 to form an array of roofing panels that are coupled together to form the roof R. In embodiments, the roofing panels 103 can be releasably secured to the connectors 107, 111 so that one or more of the roofing panels can be removed from the roof structure while the remaining roofing panels in the roof structure remain in the assembled configuration. For example, if a roofing panel is damaged, it could be removed by removing the second connectors 111 from the damaged roofing panel and the adjacent roofing panels, e.g., by removing the fasteners 143 and pulling the second connectors 111 away from the roofing panels 103. Additionally, the fasteners 141 will be removed from the damaged roofing panel to release the damaged roofing panel from the first connectors 107. Still further, in embodiments where the damaged roofing panel is mounted to intermediate rafters 105 by spacers 145, the fasteners 149 also can be removed from the damaged roofing panel to release the damaged roofing panel from the spacers 145.

With the damaged roofing panel removed from the roof structure, a replacement roofing panel can be installed in its place. For example, the replacement roofing panel can be secured to the first connectors 107 by the fasteners 141 and to the spacers 145 by the fasteners 149. The overlapping portion 125 of the third layer 121 (e.g., a TPO membrane of the replacement roofing panel) can be adhered to the exterior surface 113 of the adjacent roofing panel downslope from the replacement roofing panel to cover and seal the seam 123 formed therebetween and an overlapping portion 125 of the TPO membrane of an adjacent roofing panel upslope from the replacement roofing panel can be adhered to the exterior surface 113 of the replacement roofing panel to cover and seal the seam 123 therebetween. The second connectors 111 can be repositioned opposite to the respective first connectors 107 and secured to the replacement roofing panel and the respectively adjacent roofing panels with the fasteners 143. In some embodiments a sealant adhesive can be applied to seal the flanges 131*a*/131*b* of the second connectors 111 to the exterior surface 113 of the roofing panels along the peripheral side portions thereof.

Figure 7:
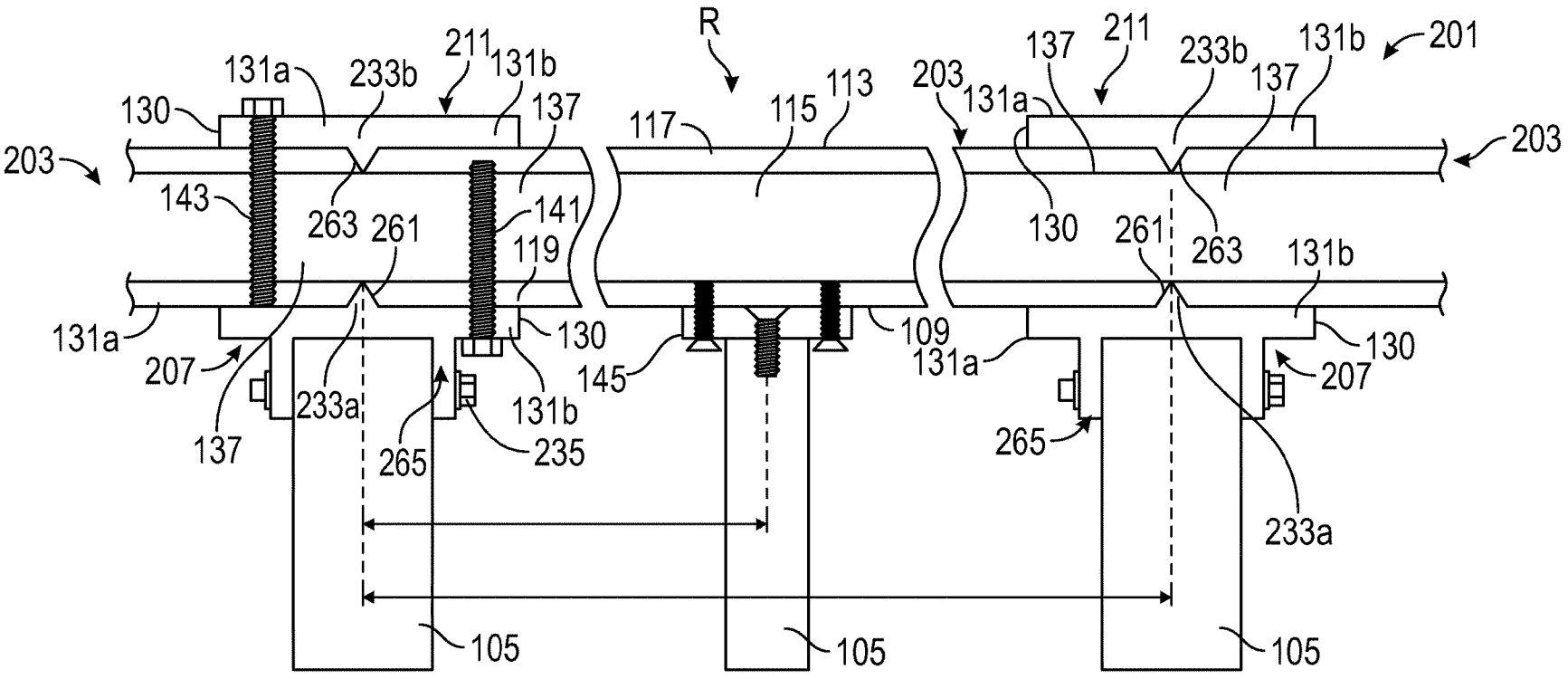
FIG. 7 is a schematic cross-sectional view of a roofing system according to another embodiment of the present disclosure.

In an embodiment shown in FIG. 7, first and second connectors 207, 211 have an alternative cross-section to the T-shaped cross-section of the connectors 107, 111 of FIGS. 1 and 2. For example, the connectors 207, 211 can have respective triangular projections 233*a*, 233*b* extending from the respective plates 130 thereof. As shown in FIG. 7, the roofing panels 203 can be configured to be in an abutting relationship when mounted to the first connectors 207 (e.g., so that the side edges of each roofing panel 203 abuts respective side edges of adjacent roofing panels 203). Accordingly, each roofing panel 203 can have a width that is equal to the on center spacing of the first connectors 207 (e.g., the roofing panels 203 can have a width of 4 feet and the rafter connectors 207 can be mounted on rafters 105 that are spaced apart by 4 feet on center).

Alternatively, the edges of the roofing panels 203 could be spaced apart (e.g., slightly spaced apart). In embodiments, for each location where two adjacent roofing panels 203 abut one another, a chamfer 261 also can be formed in the two adjacent roofing panels 203 at the bottom surfaces 109 (FIG. 7) and an opposing chamfer 263 can be formed in the two adjacent roofing panels 203 at the exterior surfaces 113. As shown in FIG. 7, the chamfers 261, 263 can have a generally V-shaped configuration adapted to at least partially receive the respective triangular projections 233*a*, 233*b* when the connectors 207, 211 are mounted to the two adjacent roofing panels 203. Other configurations of the chamfers and projections also can be provided.

As also shown in FIG. 7, each of the first connectors 207 further can include a mounting bracket 265 that can extend downwardly from the plate 130 along the opposing vertical faces of the respective rafter 105. In an exemplary embodiment, fasteners 235 can extend through the mounting bracket 265 and the associated rafter 105. Alternatively, the first connectors 207 could be secured to the rafters 105 with fasteners 135 via the flanges 131*a*/131*b* similarly to the first connectors 107 shown in FIG. 2.

Figure 8:
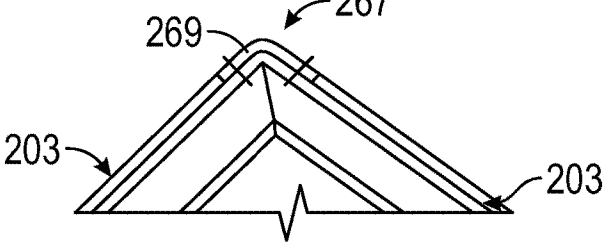
FIG. 8 is a schematic cross-sectional view of a ridge of a roof formed with a roofing system according to embodiments of the present disclosure.

As shown in FIG. 8, the roofing panels 203 (or the roofing panels 103) can be arranged along a ridge 267 of the roof, and ridge caps 269 can be mounted to transition between the roofing panels 203 along the crest of the ridge 267 (e.g., with fasteners, adhesives, and/or other suitable features). In some embodiments, the ridge cap 269 can include cap shingles, and/or can include a ridge vent extending along the ridge 267.

Any of the features of the various embodiments of the disclosure can be combined with replaced by, or otherwise configured with other features of other embodiments of the disclosure without departing from the scope of this disclosure. The configurations and combinations of features described above and shown in the figures are included by way of example.

The present disclosure has been described herein in terms of examples that illustrate principles and aspects of the present disclosure. The skilled artisan will understand, however, that a wide gamut of additions, deletions, and modifications, both subtle and gross, may be made to the presented examples without departing from the spirit and scope of the present disclosure.

The invention claimed is:

1. A roofing system, comprising:

a plurality of rafters;

a plurality of roofing panels comprising at least a first roofing panel and a second roofing panel positioned on opposite sides of at least one rafter;

a membrane positioned over an upper surface of the first roofing panel and the second roofing panel;

a first connector secured to the at least one rafter;

a second connector positioned opposite the first connector; and a plurality of fasteners, at least some of the fasteners configured to be extended through at least some of the first and second connectors and through the first and second roofing panels;

wherein the second connector is fastened to the first connector with adjacent peripheral side portions of the first roofing panel and second roofing panel engaged and held between the first connector and the second connector to couple the first roofing panel and second roofing panel together along the at least one rafter;

wherein the plurality of roofing panels further comprises a third roofing panel positioned downslope from the first roofing panel or the second roofing panel; and wherein the membrane includes an overlap portion configured to at least partially overlap an upper surface of the third roofing panel so as to form a seal configured to resist migration of water between the third roofing panel and the first roofing panel or the second roofing panel.

2. The roofing system of claim 1, wherein each of the first and second connectors comprises a pair of flanges and a projection located between the flanges, and wherein a first one of the flanges is fastened to the first roofing panel and a second one of the flanges is fastened to the second roofing panel with the projection at least partially received along a joint defined between the first roofing panel and the second roofing panel between the first and second roofing panels.

3. The roofing system of claim 2, wherein the projection and the flanges of the first connector define a T-shaped cross-section of the first connector, and wherein the projection and the flange of the second connector define a T-shaped cross-section of the second connector.

4. The roofing system of claim 1, wherein the first second connector is at least partially secured to the upper surface of the first roofing panel and to the upper surface of the second roofing panel with a sealant.

5. The roofing system of claim 1, wherein the overlap portion is bonded to the upper surface of the third roofing panel and is configured to cover a seam formed between adjacent edges of the first roofing panel and the third roofing panel.

6. The roofing system of claim 1, wherein at least some of the roofing panels of the plurality of roofing panels comprise oriented strand board; laminate panels, wood panels, metal panels, or a combination thereof.

7. The roofing system of claim 1, wherein each of the roofing panels comprises a core, a first layer of material overlying the core, and a second layer of material underlying the core.

8. The roofing system of claim 7, wherein the core comprises polyisocyanurate, polystyrene, PVC, polyethylene, polyamide, phenolic material, or a combination thereof; and the first and second layers each comprise a polymer material, metal, wood, or a combination thereof.

9. The roofing system of claim 7, further comprising a third layer of material overlying the first layer of material, the third layer comprising a thermoplastic membrane, a gripping material layer having a plurality of gripping features configured to mechanically couple the first and second roofing panels together, or a combination thereof.

10. The roofing system of claim 1, wherein the first and second roofing panels further comprise a first chamfer formed in the first roofing panel and the second roofing panel along the adjacent peripheral side portions thereof, and a second chamfer opposite the first chamfer and formed in the first and second roofing panels along the adjacent peripheral side portions thereof; wherein the first chamfer is configured to receive a projection of the first connector and the second chamfer is configured to receive a projection of the second connector when the first and second roofing panels are engaged between the first and second connectors.

11. The roofing system of claim 1, wherein at least one of the first and second connectors further comprises a projection configured to engage a chamfer defined along the adjacent peripheral side portions of the first roofing panel and second roofing panel when the first and second roofing panels are engaged between the first and second connectors.

12. The roofing system of claim 1, further comprising an adhesive applied between the overlap portion and the third roofing panel and configured to secure the overlap portion to an exterior surface of the third roofing panel.

13. A roofing system, comprising:

a plurality of rafters;

a plurality of roofing panels each configured to span a distance between adjacent rafters, each of the roofing panels comprising an upper surface and a lower surface;

a membrane positioned over the upper surface of the each of roofing panels and configured to resist migration of water therethrough; and a plurality of connectors, including:

a first connector fastened to a rafter and configured to releasably attach to a first roofing panel and a second roofing panel;

a second connector opposite the first connector; and a plurality of fasteners extending through the first and second connectors and through the first and second roofing panels to releasably secure the first and second connectors to the first and second roofing panels;

wherein the fasteners are configured to fasten the first connector to the rafter and fasten the second connector to the first connector with adjacent peripheral side portions of the first roofing panel and the second roofing panel engaged therebetween so as to couple the first roofing panel and second roofing panel together along the rafter;

wherein the membrane includes an overlap portion configured to at least partially overlap an upper surface of a third roofing panel downslope from the first roofing panel or the second roofing panel so as to form a seal configured to resist migration of water between the third roofing panel and the first roofing panel or the second roofing panel.

14. The roofing system of claim 13, wherein each of the first and second connectors comprises a pair of flanges and a projection located between the flanges, and wherein the first roofing panel and the second roofing panel are received and engaged between opposing flanges of the first roofing panel and the second roofing panel with the projection at least partially received along a joint defined between the first roofing panel and the second roofing panel.

15. The roofing system of claim 13, wherein the second connector is at least partially secured to the upper surface of the first roofing panel and to the upper surface of the second roofing panel with a sealant.

16. The roofing system of claim 13, further comprising an adhesive applied between the overlap portion and the third roofing panel and configured to secure the overlap portion upper surface of the third roofing panel.

17. The roofing system of claim 13, wherein each of the roofing panels comprises a core; wherein the core comprises polyisocyanurate, polystyrene, PVC, polyethylene, polyamide, phenolic material, or a combination thereof.

18. The roofing system of claim 17, further comprising one or more layers overlying the upper surface of the core and one or more layers underlying the lower surface of the core; wherein the one or more layers overlying the upper surface of the core and the one or more layers underlying the lower surface of the core each comprise a polymer material, metal, wood, or a combination thereof.

19. The roofing system of claim 18, further comprising a gripping material layer applied to the core and having a plurality of gripping features configured to mechanically couple the first and second roofing panels together.

* * * * *